United States Patent [19]

Murphy

[11] 4,067,548

[45] Jan. 10, 1978

[54] RAILING

[76] Inventor: John J. Murphy, c/o McKeon, Inc. 1523 N. 27th St., Philadelphia, Pa. 19121

[21] Appl. No.: 704,477

[22] Filed: July 12, 1976

[51] Int. Cl.[2] ..... E04H 17/16

[52] U.S. Cl. ..... 256/24; 256/65

[58] Field of Search ..... 256/24, 59, 65, 21

[56] References Cited

U.S. PATENT DOCUMENTS

| | | | |
|---|---|---|---|
| Re. 28,643 | 12/1975 | Blum | 256/24 |
| 3,358,969 | 12/1967 | Blum et al. | 256/59 X |
| 3,468,516 | 9/1969 | Jounot | 256/24 |
| 3,593,963 | 7/1971 | Horgan, Jr. | 256/59 X |
| 3,630,490 | 12/1971 | Horgan, Jr. | 256/24 |

*Primary Examiner*—Andrew V. Kundrat

[57] ABSTRACT

A railing has a plurality of aligned glass panels. A pair of support members are secured to opposite sides of the bottom of each glass panel with each support member having a cap and a depending plate secured to the glass panel. A railing base has a groove removably receiving the bottom of each glass panel and the plates of the support members with the caps resting on the top of the railing base and secured thereto. The railing base, in turn, is removably secured to a supporting structure. A handrail is mounted on the top of the glass panels. The handrail comprises a plurality of inverted channel members each receiving the upper portion of at least one glass panel. A bar is connected to the tops of adjacent inverted channel members to secure them together. A cap is telescoped over the channel members.

6 Claims, 3 Drawing Figures

RAILING

BACKGROUND OF THE INVENTION

It is known in the art to provide a railing in which a plurality of aligned glass panels are mounted in a channel member and are the sole support for a handrail mounted on the upper end of the glass panels. Such a structure is disclosed in U.S. Pat. No. Re 28,643 of Dec. 9, 1975 and reference may be had to the prior art listed in said patent. U.S. Pat. No. Ref. 28,643 discloses a mounting bracket having a channel which receives the bottoms of the glass panels which are bonded to the bracket by an adhesive. In the event that a glass panel is broken, this structure makes it impractical to reuse the mounting bracket due to the difficulty of removing the glass from the narrow and deep channel. Applicant has solved this problem by providing a reusable glass panel support having separate plates on opposite sides of the lower end of the glass panel which permits the separation from the glass panel of the adhesively secured plates easily since there is no channel from which the glass must be removed as in U.S. Pat. No. Ref.28,643. While U.S. Pat. No. Ref.28,643 also discloses a glass panel supported by members bolted to opposite sides of the bottom of the glass panel, this arrangement is for side mounting and is not suitable for mounting on an underlying supporting structure.

U.S. Pat. No. Ref.28,643 discloses a handrail secured to the top of a panel which comprises an inverted channel member and a cap fitted thereover. The inverted channel member and telescoping cap of this invention is of a simplified and more attractive design and employs a unique means for securing together adjacent inverted channel members.

BRIEF SUMMARY OF THE INVENTION

A railing comprises a plurality of aligned glass panels. A pair of support members are secured to opposite sides of the bottom of each glass panel with each support member having a cap and a depending plate secured to the glass panel. A railing base has a groove removably receiving the bottom of each glass panel and the plates of the support members with the caps resting on the top of the railing base and preferably removably secured thereto. The railing base, in turn, is adapted to be removably secured to a supporting structure. A handrail is mounted on the top of the glass panels. Advantageously, each handrail comprises a plurality of inverted channel members each receiving the upper portion of at least one Glass panel and a bar is received by adjacent channel members to lock them together. Preferably, the bar is received on the top of the channel members which is covered by a cap which is telescoped over the channel members and has at least one flange between the top and bottom thereof to limit the downward movement of the cap.

DETAILED DESCRIPTION

Figure 1:
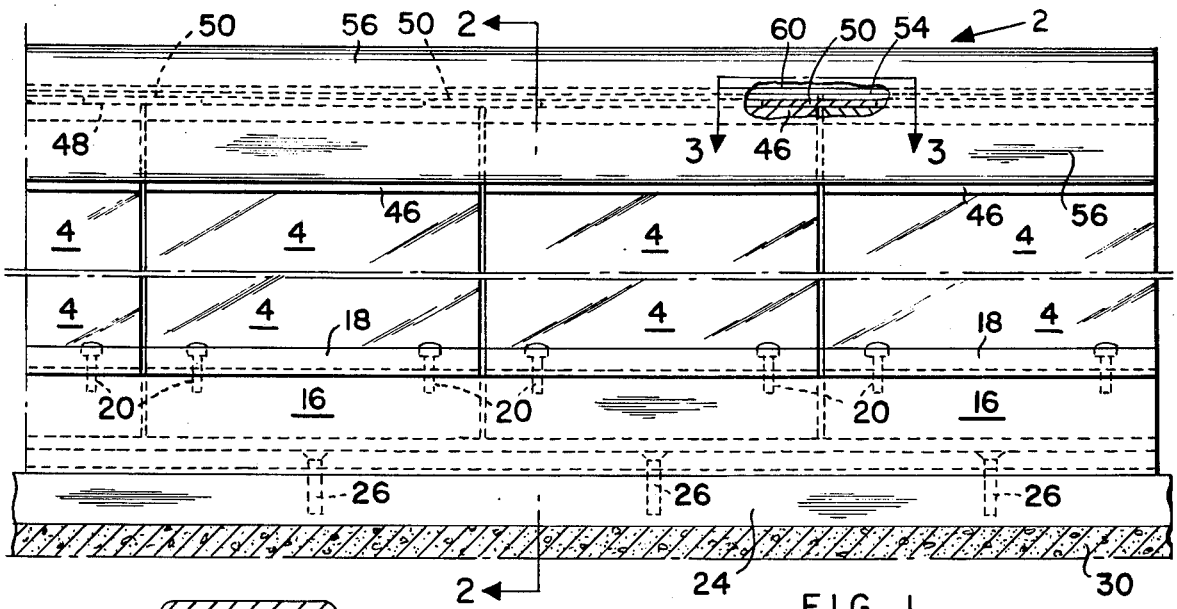
FIG. 1 is an elevation, partially broken away, of a railing in accordance with the invention.
Figure 2:
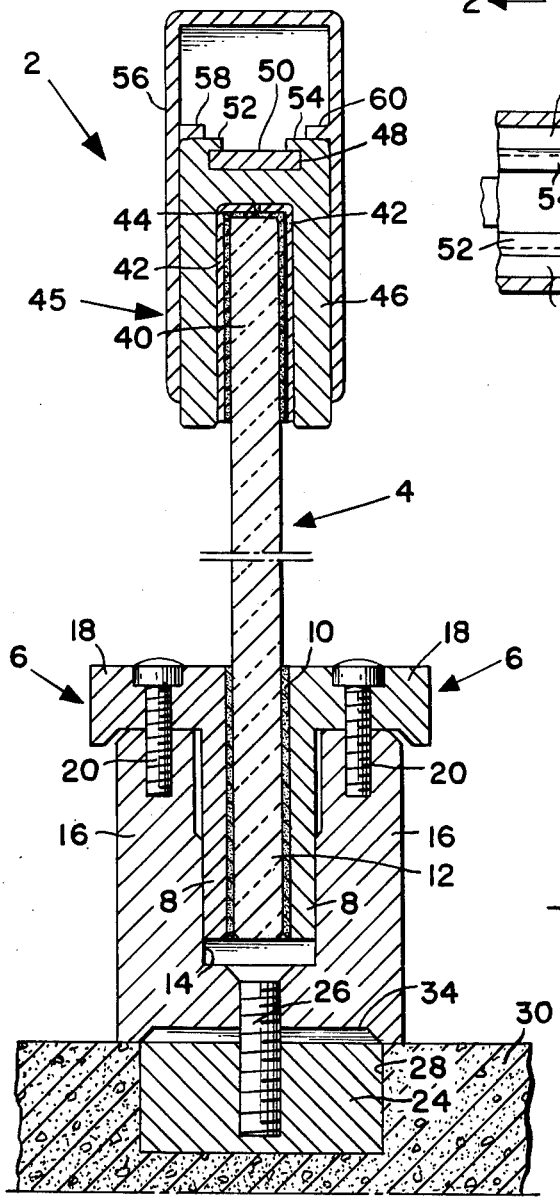
FIG. 2 is a section taken on the plane indicated by the line 2—2 in FIG. 1.
Figure 3:
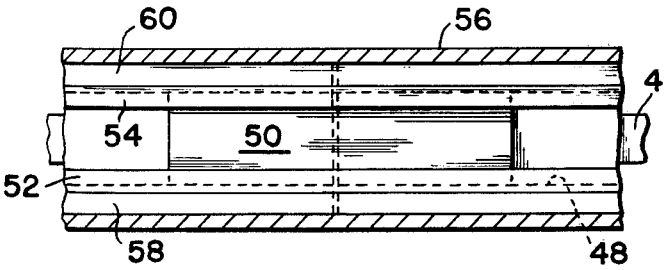
FIG. 3 is a section, partially broken away, taken on the plane indicated by the line 3—3 in FIG. 1.

A railing 2 in accordance with the invention has a plurality of aligned glass panels 4. A pair of support members or base caps 6 for each panel 4 each have a depending plate 8. The plates 8 are secured by an adhesive layer 10 to opposite sides of the bottom 12 of each panel 4. Support members 6 and the bottom 12 of each panel 4 are received in a groove 14 of railing base 16. Each support member 6 has an integral cap 18 which rests on the top of railing base 16 and is removably secured thereto by bolts indicated at 20. Railing base 16 is secured to a bar 24 by bolts 26. Bar 24 is secured in a recess 28 of a concrete floor 30. The bottom of railing base 16 has a recess 34 for the reception of a shim (not shown) if needed.

The top 40 of each panel 4 has on opposite sides thereof an inverted L-shaped piece of trim 42 secured thereto by an adhesive layer 44. A handrail 45 includes an inverted channel member 46 overlying the trim 42,42, and member 46 is secured to trim 42,42 by a pressed fit. The upper end of inverted channel member 46 has an opening 48 for the reception of a securing bar 50 that is retained in opening 48 by opposed flanges 52 and 54. Bar 50 extends between two adjacent inverted channel members 46 in order to lock them together. A handrail cap 56 is telescoped over inverted channel member 46 and is secured thereto by a pressed fit. Handrail cap 56 has internal flanges 58 and 60 that rest on the top of inverted channel member 46 and hide from view openings 48 and bars 50.

Materials conventionally used in forming the railing parts other than the conventional glass and adhesive may be employed to make the railing of the invention. However, metal is preferred. Advantageously, the bar 24 is of steel and the support members 6, railing base 16, trim 42, inverted channel 46, bar 50 and handrail cap 56 are of aluminum.

If a glass panel 4 is broken, handrail cap 56 is removed and then the inverted channel member 46 of broken panel 4 is unlocked from the adjacent members 46 by sliding bars 50 clear of the said adjacent members. Bolts 20 are removed from the support members 6 attached to the broken panel 4 and the support members 6 and panel 4 removed from the railing base. A hammer or the like is then used to separate the support members 6 from panel 4 in order that the support members can be attached to a new plate 4. This can be done on the job site, thus avoiding costly factory fabrication and delay.

It will be understood that the above described embodiment is illustrative and is not intended to be limiting.

I claim:

1. A railing comprising a plurality of aligned glass panels, a pair of support members secured to opposite sides of the bottom of each glass panel with each member having a support cap and a depending plate secured to the glass panel, a railing base having a groove removably receiving the bottom of each glass panel and the plates of said members with the support caps of said members resting on top of the railing base, and a handrail mounted on top of the glass panels, said handrail comprising a plurality of inverted channel members each receiving the top of at least one glass panel and locking means including a bar to lock adjacent channel members together.

2. A railing in accordance with claim 1 having means to removably secure the support caps to the railing base and means to secure the railing base to a supporting structure.

3. A railing in accordance with claim 1 in which the depending plates are secured to the glass panel by an adhesive layer.

4. A railing in accordance with claim 1 in which the locking means is on the top of the channel members and a handrail cap overlies the channel members.

5. A railing in accordance with claim 4 in which the handrail cap has at least one internal flange between the top and bottom of the handrail cap to limit the downward movement of the handrail cap.

6. A railing comprising a plurality of aligned glass panels, a pair of support members secured to opposite sides of the bottom of each glass panel with each member having a support cap and a depending plate secured to the glass panel, a railing base having a groove removably receiving the bottom of each glass panel and the plates of said members with the support caps of said members resting on top of the railing base, and a handrail mounted on the top of the glass panels, means to removably secure the support caps to the railing base and means to secure the railing base to a supporting structure, said depending plates being secured to the glass panel by an adhesive layer, said handrail comprising a plurality of inverted channel members each receiving the top of at least one glass panel and locking means including a bar to lock adjacent channel members together, said locking means being on the top of the channel members and a handrail cap overlying the channel members, said handrail cap having at least one internal flange between the top and bottom of the handrail cap to limit the downward movement of the handrail cap.

* * * * *